United States Patent [19]

DeMaria

[11] 4,296,059

[45] Oct. 20, 1981

[54] PRESSURE SEALING PROCESS

[75] Inventor: Francesco DeMaria, Gulf Breeze, Fla.

[73] Assignee: American Cyanamid Company, Stamford, Conn.

[21] Appl. No.: 59,928

[22] Filed: Jul. 20, 1979

Related U.S. Application Data

[63] Continuation-in-part of Ser. No. 938,203, Aug. 30, 1978, abandoned.

[51] Int. Cl.[3] ..... B29H 21/04

[52] U.S. Cl. ..... 264/130; 34/242; 68/5 E; 264/176 F; 264/206; 277/3

[58] Field of Search ..... 68/5 E; 8/149.3; 264/206, 176 F, 130; 34/242, 68, 18, 41; 277/3

[56] References Cited

U.S. PATENT DOCUMENTS

| | | | |
|---|---|---|---|
| 2,708,843 | 5/1955 | Gieson et al. | 68/5 |
| 2,920,934 | 1/1960 | Schaefer et al. | 8/130.1 |
| 2,932,183 | 4/1960 | Richeson | 68/5 |
| 3,012,427 | 12/1961 | Osban | 68/5 |
| 3,027,740 | 4/1962 | Sonnino | 68/5 |
| 3,037,369 | 6/1962 | Leins et al. | 68/5 |
| 3,046,773 | 7/1962 | Healey | 68/22 |
| 3,061,940 | 11/1962 | Cichelli | 34/68 |
| 3,066,006 | 11/1962 | Sonnio | 8/151.2 |
| 3,083,073 | 3/1963 | Leins et al. | 8/149.3 |
| 3,083,075 | 3/1963 | Saxton et al. | 264/188 |
| 3,118,154 | 1/1964 | Osban et al. | 8/149.3 |
| 3,126,724 | 3/1964 | Kolonits | 68/5 |
| 3,137,151 | 6/1964 | Yoshiike | 68/5 |
| 3,152,379 | 10/1964 | Osban | 28/1 |
| 3,230,745 | 1/1966 | Bittle et al. | 68/5 E |
| 3,240,037 | 3/1966 | Bittle et al. | 68/5 E |
| 3,241,343 | 3/1966 | Yazawa | 68/5 E |
| 3,245,334 | 4/1966 | Long | 34/242 |
| 3,394,940 | 7/1968 | Lane | 68/5 E |
| 3,410,672 | 11/1968 | De Lafarte | 65/3 |
| 3,783,649 | 1/1974 | Yamamoto et al. | 68/5 E |
| 3,927,540 | 12/1975 | Tanaka et al. | 277/DIG. 7 |
| 3,999,970 | 12/1976 | Barch et al. | 65/2 |
| 4,030,901 | 6/1977 | Kaiser | 65/2 |
| 4,163,770 | 8/1979 | Porosoff | 264/206 |

FOREIGN PATENT DOCUMENTS

| | | | |
|---|---|---|---|
| 842652 | 5/1970 | Canada | 277/237 R |
| 38-12607 | 7/1963 | Japan | 68/5 E |
| 765632 | 1/1957 | United Kingdom | 65/13 |

*Primary Examiner*—Jay H. Woo
*Attorney, Agent, or Firm*—Frank M. Van Riet

[57] ABSTRACT

A fiber tow bundle passing from a high pressure zone through the passageway of a sealing zone to a low pressure zone provides an effective pressure seal when liquid water under pressure diffuses through the surface of the passageway as the fiber tow bundle passes therethrough.

3 Claims, 1 Drawing Figure

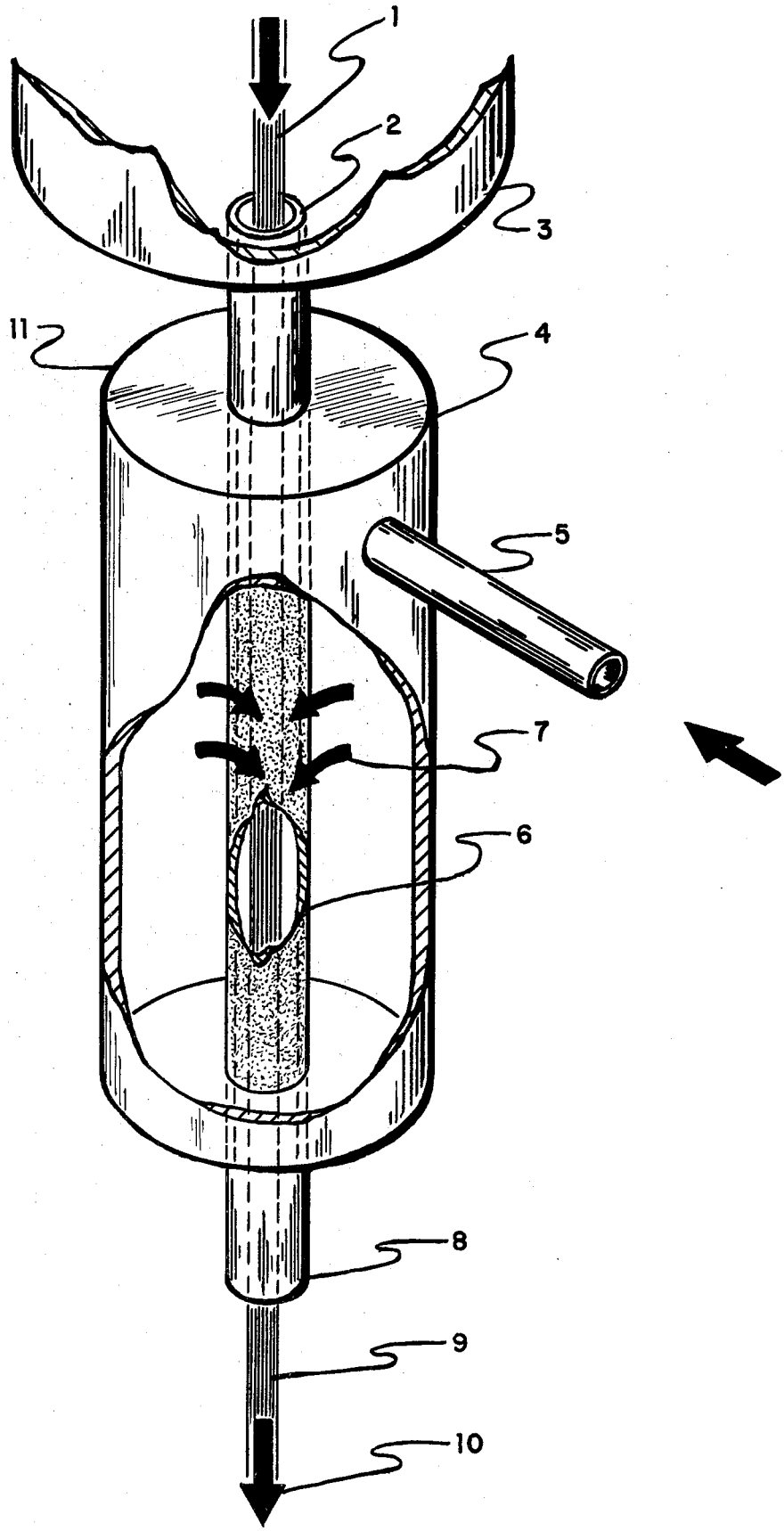
1
2
3
11
4
5
7
6
8
9
10

PRESSURE SEALING PROCESS

CROSS-REFERENCE TO RELATED APPLICATION

This application is a continuation-in-part of application Ser. No. 938,203 filed Aug. 30, 1978 now abandoned.

This invention relates to a process for transferring a fiber tow bundle from a high pressure zone to a low pressure zone in a manner which maintains pressure values of the individual zones and minimizes fiber damage. More particularly, this invention relates to such a process wherein the fiber tow bundle in conjunction with liquid water under pressure provide an effective pressure seal for such transfer.

In spinning fiber tow bundles from fiber-forming polymer compositions it is often necessary to transfer the fiber tow bundle between two zones maintained at different pressures. Numerous procedures have been proposed for such transfer while sealing the individual zones against changes in pressure as a result of such transfer. Most of these processes attempt to contain the fiber between two metal surfaces either in the form of cylinders or spring-loaded devices such as vanes, wipers, or the like. Usually water floods these devices to contain the tow and remove debris. One such illustrative process employs an orifice seal which allows fluid to rush into the seal along with the tow. Use of such form of seal causes turbulence which disturbs the tow causing it to vibrate and abrade against the containing orifice. As a result, processing of the tow is difficult to conduct and damaged fiber results. Other methods employ gases to effect sealing and the high gas pressures required for sealing can also result in damaged fiber.

Recent developments have led to a melt-spinning process for preparing acrylonitrile polymer fiber using as the spinning composition a homogeneous single-phase melt of the polymer and water. Such spinning composition is extruded through a spinnerette at a temperature which is above the boiling point of water at atmospheric pressure and at a pressure which maintains water in liquid phase. A particularly desirable method of carrying out such processing is to extrude the melt directly into a steam-pressurized solidification zone maintained under conditions which control the rate of release of water from the nascent extrudate and enable the extrudate to be stretched for polymer orientation, as described in U.S. Pat. No. 4,163,770 issued Aug. 7, 1979 to Porosoff. After the extrudate is processed through the steam-pressurized solidification zone, it is released to the atmosphere, thus transferring from a high pressure zone to a low pressure zone. Such process, as well as numerous others, requires effective sealing during transfer of the extrudate, which is in the form of a fiber tow bundle, from the high pressure zone to the low pressure zone without fiber damage. Attempts to accomplish such transfer following conventional procedure have not been satisfactory and have led to damaged fiber which interferes with subsequent processing and reduces productivity.

What is needed, therefore, is a process for transferring a fiber tow bundle from a high pressure zone to a low pressure zone which avoids deficiencies of the prior art processes. Such a provision would satisfy a long-felt need and constitute a significant advance in the art.

In accordance with the present invention, there is provided a process for transferring a moving fiber tow bundle from a high pressure zone to a low pressure zone which comprises: (a) passing said fiber tow bundle through a passageway contained in a sealing zone which provides liquid water under pressure thereto, said sealing zone being located between said high pressure zone and said low pressure zone, said passageway being confined and elongated and having a continuous elongated surface adapted to receive a coating of liquid water under pressure thereon by diffusion therethrough of liquid water under pressure from said sealing zone, and said passing being conducted while said coating of liquid water is continuously diffused onto said passageway surface so that said water coating and said fiber tow bundle cooperate to produce an effective pressure seal within the length and confines of said passageway and said water coating prevents contact of said fiber tow bundle with said passageway surface; and (b) receiving said fiber tow bundle in said low pressure zone.

When processing is carried out in accordance with the present invention, changes in pressure are not observed in the high and low pressure zones, and substantially no damaged fiber results. The process enables rapid production rates to be accomplished and involves relatively simple modifications to effect operation.

In carrying out processing using the process of the present invention, it is necessary to interpose a sealing zone between the high pressure zone and low pressure zone between which transfer of the fiber tow bundle is desired. A particularly suitable sealing zone for use in the process of the present invention is illustrated in the sole FIGURE of drawing which represents a cut-out isomeric view thereof.

In the drawing 11 represents a sealing zone useful in the process of the present invention which is connected to a high pressure zone 3. A tow bundle of fiber 1 enters the sealing zone through entrance 2 and passes through passageway 6 which is contained in body member 4 of the sealing zone which receives liquid water under pressure through inlet 5. The fluid under pressure diffuses to the surface of the passageway through porosity 7 uniformly distributed thereover. The liquid water diffuses toward the center of the passageway and contacts the fiber tow bundle and together the liquid water and fiber tow bundle is kept out of contact with the surface of the passageway. The discharging tow 9 emerges from exit 8 into a low pressure zone 10 where it is received along with the liquid water.

In operation, the fiber tow bundle from the high pressure zone is passed directly through the passageway of the sealing zone while liquid water under pressure is continuously diffused through the surface of the passageway. The passageway should be of suitable dimensions to provide effective confinement of the fiber tow bundle and liquid water to provide an effective pressure seal within the length of the passageway. As is readily apparent, the extent of confinement and length of the passageway may vary widely and are not particularly critical so long as an effective pressure seal is developed while the liquid water and fiber tow bundle pass therethrough.

The diffusion of water through the surface of the passageway is occasioned by porosity thereof. This may be readily accomplished by use of minute holes drilled by electro-etching techniques, by powder metallurgy such as sintered metal surfaces, or any suitable procedure involving metals or other maaterials of construction. The passageway surface should be sufficiently porous to provide a liquid water surface distributed over its expanse during processing.

The sealing zone will comprise the passageway described and a body member jacketing the passageway and diffusing water under pressure through the surface of the passageway during operation. Pressure exerted on the liquid water in the body member will control the rate of diffusion of the liquid water. The rate of diffusion of water through the surface of the passageway should be sufficient to prevent contact of the fiber tow bundle with the surface of the passageway and provide an effective pressure seal in cooperation with the fiber tow bundle passing through the passageway.

The passageway, if desired, may be provided with perforations which cause the liquid water to swirl as it diffuses onto the passageway surface. In this way, it is subjected to rotational forces by the swirling fluid being impinged upon it. Other modifications of the passageway surface to provide similar or alternative effects are also possible.

The invention is more fully illustrated by the example which follows.

EXAMPLE

Using a sealing zone as illustrated in the drawing, acrylonitrile polymer fiber extruded into a steam-pressurized solidification zone was released to the atmosphere therethrough. The pressurized zone 3 was at 13 to 18 pounds per suqare inch gauge. The passageway 6 was 11 inches long, 0.25 inch outer diameter, 0.125 inch inner diameter, wall thickness 0.0625 inch, and porosity (air flow versus change in pressure) equivalent to 1000 standard cubic feet per minute per square foot at a pressure change of 25 pounds per square inch. The duct was made of sintered metal. The sealing zone 11 was 11 inches long and had an outside diameter of 3 inches. Water was used as sealing fluid at the rate of 0.2 gallons per minute.

A fusion melt was prepared of 86 weight percent polymer and 14 weight percent water at 160° C. and autogeneous pressure. The polymer consisted of 84.9 weight percent of acrylonitrile, 12 weight percent methyl methacrylate, 3 weight percent polyvinyl alcohol, and 0.1 weight percent acrylamidomethylpropane sulfonic acid. The polymer had a kinematic molecular weight of 42,000.

Kinematic average molecular weight ($M_k$) is obtained from the following relationship:

$$\mu = (1/A)\,\overline{m}_k$$

where $\mu$ is the average effluent time (t) in seconds for a solution of 1 gram of the polymer in 100 milliliters of 53 weight percent aqueous sodium thiocyanate solvent at 40° C. multiplied by the viscometer factor and A is the solution factor derived from a polymer of known molecular weight and in the present case is equal to 3,500.

The melt was extruded through a spinneret assembly having an orifice plate of 91 holes of diameter 150 microns spaced 1.5 millimeters center to center to provide a density of 43 holes per square centimeter. Each hole had a counterbore of 1.2 millimeter diameter. The extrudate entered directly into the steam-pressurized solidification zone at 13 to 18 pounds per square inch gauge. The extrudate was stretched in two stages. In a first stage the stretch ratio was 23.9 relative to the linear velocity of the fusion melt through the spinnerette and in the second stage the stretch ratio was 2.5. The extrudate which was in fiber form was collected at the exit 8 of the passageway at the rate of 300 meters per minute. The resulting 2.4 denier fiber showed no evidence of breakage or sticking during the run and pressure on the solidification zone remained constant during processing.

I claim:

1. A process for transferring a moving fiber tow bundle from a high pressure zone to a low pressure zone which comprises:

(a) passing said fiber tow bundle through a passageway contained in a sealing zone which provides liquid water under pressure thereto, said sealing zone being located between said high pressure zone and said low pressure zone, said passageway being confined and elongated and having a continuous longitudinal surface adapted to receive a coating of liquid water under pressure thereon by diffusion therethrough of liquid water under pressure from said sealing zone, and said passing being conducted while said coating of liquid water is continuously diffused onto said passageway surface so that said water coating and said fiber tow bundle cooperate to produce an effective pressure seal within the length and confines of said passageway and said water coating prevents contact of said fiber tow bundle with said passageway surface; and (b) receiving said fiber tow bundle in said low pressure zone.

2. The process of claim 1 wherein the moving tow bundle is obtained from melt-spinning a single-phase melt of acrylonitrile polymer and water directly into a steam pressurized solidification zone and said transferring is from said solidification zone to the atmosphere.

3. The process of claim 1 wherein said liquid water is caused to swirl as it diffuses onto said passageway surface.

* * * * *